US007523556B2

(12) United States Patent
Tye

(10) Patent No.: US 7,523,556 B2
(45) Date of Patent: Apr. 28, 2009

(54) RING EXPANSION METHOD AND DEVICE

(76) Inventor: Larry R. Tye, 20 Cypress March Dr., Hilton Head, SC (US) 29926

( * ) Notice: Subject to any disclaimer, the term of this patent is extended or adjusted under 35 U.S.C. 154(b) by 677 days.

(21) Appl. No.: 10/994,969

(22) Filed: Nov. 22, 2004

(65) Prior Publication Data

US 2006/0107527 A1 May 25, 2006

(51) Int. Cl.
*A44C 27/00* (2006.01)
*A44C 9/02* (2006.01)

(52) U.S. Cl. ..... 29/896.412; 63/15.6

(58) Field of Classification Search ..... 29/896.412, 29/896.42, 896.43, 896.4, 896.411, 453, 29/464; 63/15.6, 15.65
See application file for complete search history.

(56) References Cited

U.S. PATENT DOCUMENTS

| | | | | |
|---|---|---|---|---|
| 499,928 | A | 6/1893 | Oppenheimer | |
| 804,137 | A | 11/1905 | Kent | |
| 3,221,514 | A | 12/1965 | Newman | |
| 3,736,770 | A | 6/1973 | Kelrick | |
| 3,890,801 | A * | 6/1975 | Newman | 63/15.65 |
| 3,968,398 | A * | 7/1976 | Lehmann et al. | 315/185 S |
| 4,592,211 | A | 6/1986 | Ross | |
| 4,790,148 | A | 12/1988 | Faini | |
| 5,412,956 | A * | 5/1995 | Levy | 63/15.65 |
| 5,636,531 | A * | 6/1997 | Miller | 63/15.6 |
| 5,943,882 | A * | 8/1999 | Erb | 63/15.5 |
| 6,003,334 | A * | 12/1999 | Miller | 63/15.5 |
| 6,370,914 | B1 | 4/2002 | Bruner | |
| 2004/0103688 | A1 | 6/2004 | Flaviano | |
| 2006/0048357 | A1 * | 3/2006 | Alulis et al. | 29/8 |

* cited by examiner

*Primary Examiner*—John C Hong
(74) *Attorney, Agent, or Firm*—Harleston Law Firm, LLC

(57) ABSTRACT

A device for expanding the circumference of a ring shank includes:

(a) an expansion unit movably attachable to an inner surface of the ring shank; and (b) a single hinge pivotally attached within the ring shank about opposite the expansion unit;

wherein the expansion unit includes a first, hollow tubing section, an expansion pin or shaft having a first end portion mounted in the first tubing section, and a second, hollow tubing section slidably supporting an opposite, second end portion of the expansion pin or shaft. Also included herein is a ring comprising this ring expansion device. A method of installing a ring expansion device in a ring is also included.

18 Claims, 5 Drawing Sheets

RING EXPANSION METHOD AND DEVICE

BACKGROUND OF THE INVENTION

1. Technical Field

The present invention relates to a finger ring expansion device for expanding the circumference of a ring to temporarily enlarge the size of a ring containing the expansion device, so the ring can fit on the finger.

2. Background Information

Many men and women across the world have difficulty putting their rings on in the morning and then taking them off at night due to problems with their fingers. People with arthritis, for example, often have enlarged knuckles and pain in their finger joints, which makes it difficult or impossible to slide their ring onto their finger. Not being able to put on a wedding ring can be particularly upsetting. Some people have bruised knuckles, nail infections, cuts, or other temporary damage to the various areas of the finger. Protuberances on the finger, such as bumps caused by writing implements, corns, calluses, blisters, and bruises can also interfere with the sliding a ring onto and off the finger. Also, many people's fingers have a tendency to swell during hot summer days. Some people simply have large knuckles on comparatively small fingers, so a ring large enough to fit over their knuckle is too loose on their finger. A loose ring can be distracting and can pose a safety hazard around some machinery, cooking appliances, in aircraft, etc.

People in the jewelry industry have devised many adjustable and even some rings that can be opened up for bypassing such finger problems. However, currently available adjustable and/or openable rings have shortcomings. For example, many of these rings must be specially manufactured or assembled, which makes them quite costly. Also, the user must purchase only those rings; the user cannot simply purchase any conventional, fixed shank ring that he or she finds attractive and make it adjustable. Exposed latching members on such currently available rings may lack durability and pose safety concerns, or the rings appear bulky and unsightly. Some adjustable or openable rings include protrusions on the side of the ring, which may be caught on apparel and are not pleasing in appearance. The adjustable or openable sections of the ring can be a point of weakness subject to excessive wear and tear, damage, and even breakage. Also, many rings of this type do not have secure locking portions, which prevent the ring from slipping off a wearer's finger. Lastly, such currently available rings can be difficult and awkward to use and have the potential to injure their wearers. Thus, there is a need for a ring expansion device that overcomes these problems.

The ring expansion device of the present invention is a mechanically and structurally simple device that permits continued adjustment of a ring's circumference. The ring expansion device of the present invention may be easily and readily installed on the many types of finger rings that are available in the jewelry industry. Surprisingly, the present ring expansion device can be installed on multiple rope bands and eternity bands, for example. Since many people have oddly shaped toes that prevent them from comfortably wearing a stylish ring on their small toes, the present invention is also useful when it is installed on a toe ring.

A ring with the instant ring expansion device does not have any exposed latching members, exposed spring members, or side protrusions to pose a safety hazard. Rings utilizing the ring expansion device of the present invention encounter minimal stress during ring shank adjustment. The instant ring expansion device includes a dual locking mechanism so the ring is unlikely to fall off the finger.

Perhaps most importantly, the present ring expansion device is easy to operate and facilitates easy to control adjustment of ring size in order to safeguard against injury and for ease of use. It can be used by older people or people who do not have perfect eyesight.

The present invention allows users with arthritis or other finger problems to continue to wear and enjoy their wedding ring, and gives them the latitude to purchase and wear any other ring they find attractive. Although this is a small thing in life, it contributes to a feeling of power over this often debilitating disease.

BRIEF SUMMARY OF THE INVENTION

The present invention is a device for expanding the circumference of a ring at any time. The ring expansion device includes:

(a) an expansion unit movably attachable to an inner surface of the ring shank; and (b) a single hinge pivotally attached within the ring shank about opposite the expansion unit;

wherein the expansion unit comprises a first, hollow tubing section, an expansion pin or shaft having a first end portion mounted in the first tubing section, and a second, hollow tubing section slidably supporting an opposite, second end portion of the expansion pin or shaft. Also included herein is a ring comprising the ring expansion device.

Also included herein is a method of installing a ring expansion device on a ring, which includes the steps of:

(a) making first and second cuts through a shank of the ring, the first cut being about diametrically opposite the second cut, and the cuts forming a first shank portion and a second shank portion;

(b) pivotally linking the first shank portion and the second shank portion at the first cut with a hinge;

(c) attaching a first, hollow tubing section of an expansion unit to an inner edge of the first shank portion adjacent the second cut;

(d) sliding a second end portion of an expansion pin or shaft with a first end portion attached inside a second hollow tubing section into the hollow first tubing section; and (e) attaching the second hollow tubing section of the expansion unit to an inner edge of the second shank portion adjacent the second cut.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
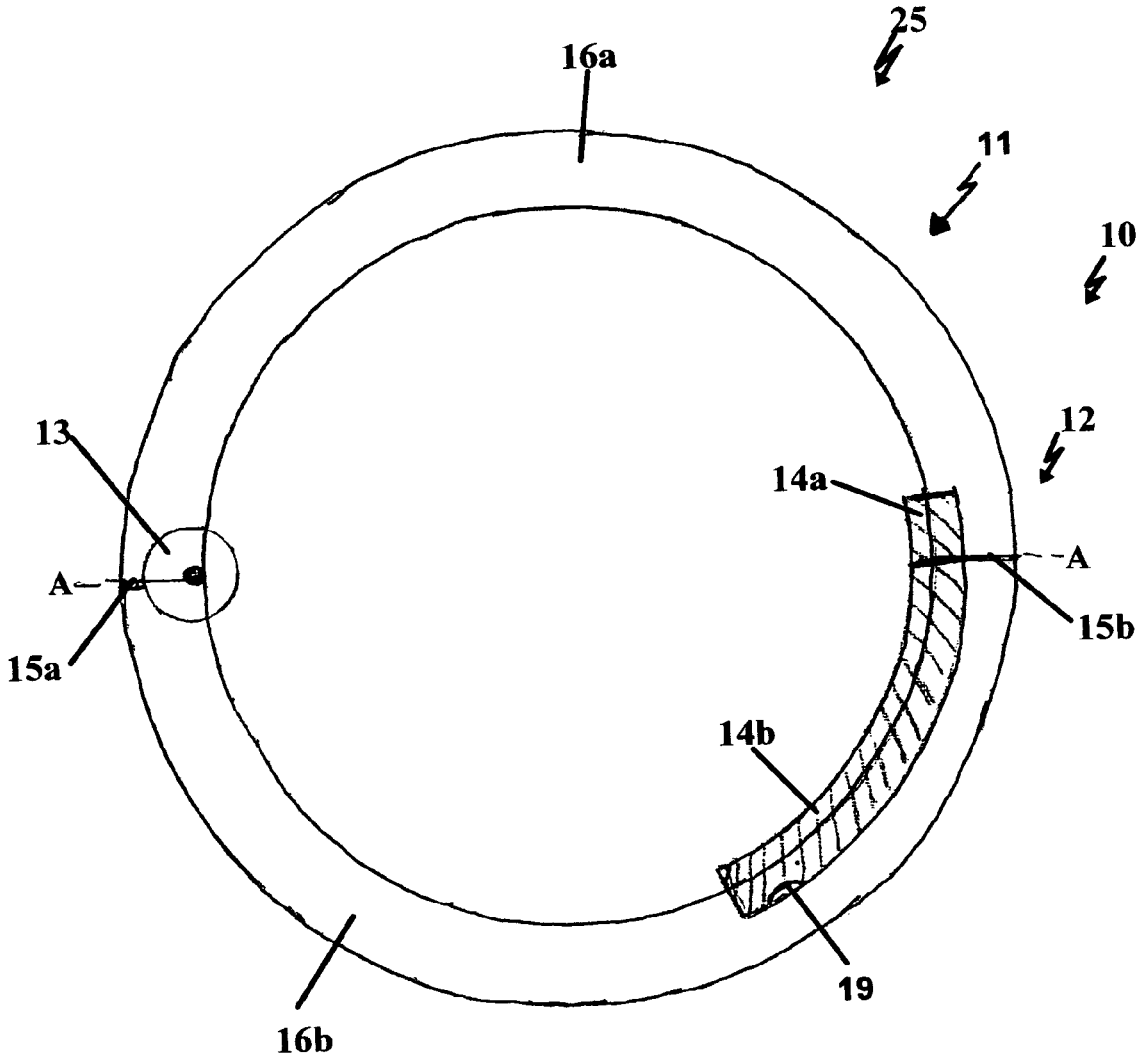
FIG. 1 is a top plan view of a ring expansion device according to the present invention, shown in a closed position.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Turning first to FIG. 1, a ring expansion device 10 according to the present invention for adjusting the size of a ring shank 11 comprises an expansion unit 12 and a hinge 13. The expansion unit 12 is comprised of a first, hollow tubing section 14*a*, a second, hollow tubing section 14*b*, and an internal expansion pin or shaft 17 (see FIG. 2). When the ring expansion device 10 is in place on a ring 25, the hinge 13 pivotally connects a first shank portion 16*a* and a second shank portion 16*b*, which are separated by a first cut 15*a* in the ring shank 11. The expansion unit 12 attaches the first shank portion 16*a* to the second shank portion 16*b*. The opposite ends of the first shank portion 16*a* and the second shank portion 16*b* are separated by a second cut 15*b* in the ring shank 11.

Figure 2:
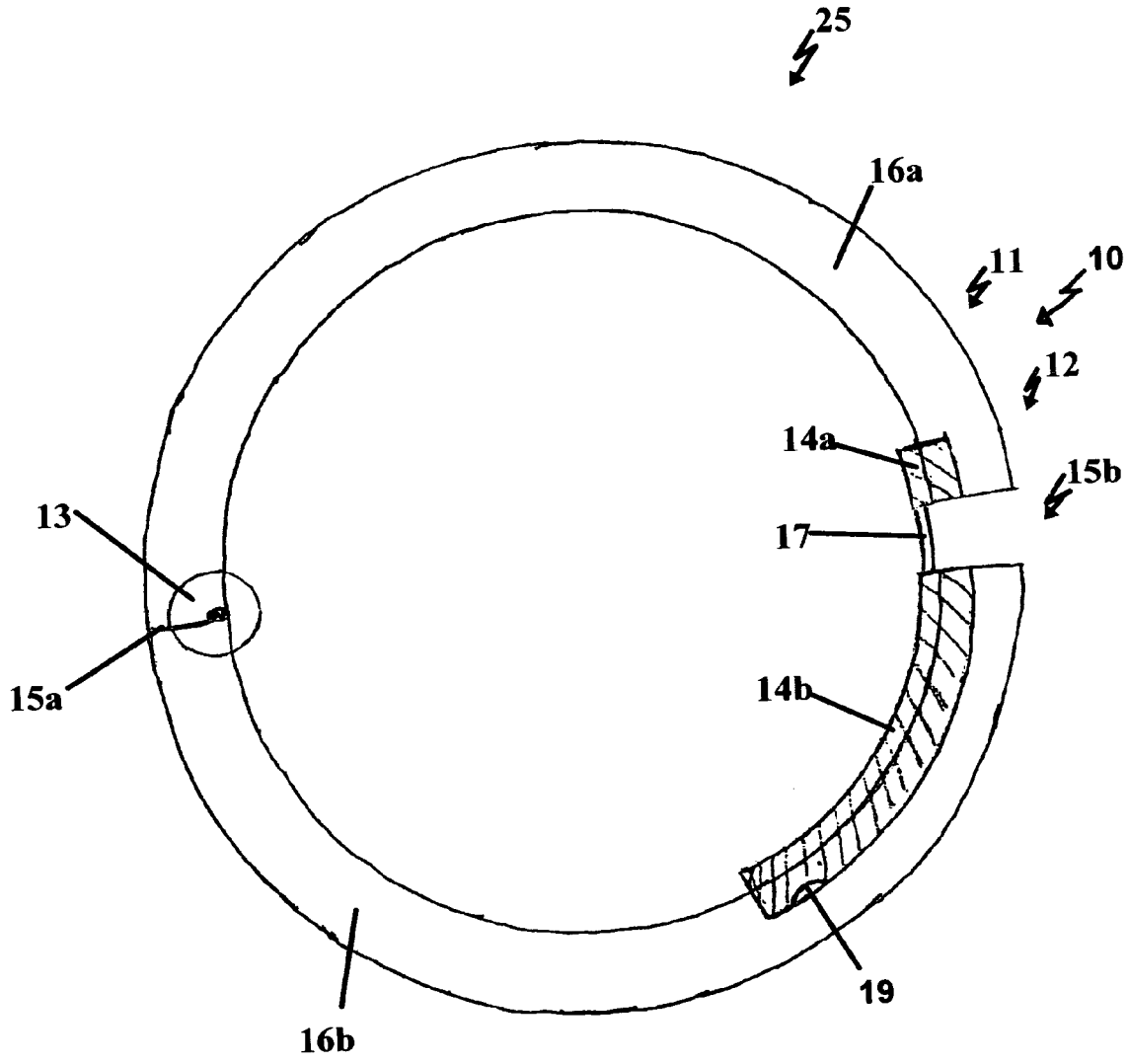
FIG. 2 is a top plan view of a ring expansion device according to the present invention, shown in an expanded position.

Continuing with FIG. 1 and also referring to FIG. 2, the first tubing section 14*a* of the expansion unit is attached to an inner surface of a first shank portion 16*a* adjacent the first cut 15*a*. The second tubing section 14*b* is attached to an inner surface of a second shank portion 16*b*, also adjacent the first cut 15*a*. One end of the expansion pin or shaft 17 is mounted within the first tubing section 14*a*, preferably by soldering. An opposite end of the expansion pin 17 is movable along the longitudinal axis of the second tubing section 14*b*. Both tubing sections 14*a*, 14*b* extend along the inside curvature of the ring shank 11. The expansion pin 17 is similarly curved so that it conforms to and fits closely in the second tubing section 14*b*.

The ring expansion device 10 has a closed position, as shown in FIG. 1, in which the tubing sections 14*a*, 14*b* abut one another and the expansion pin 17 is fully inserted in the second tubing section 14*b*. The ring expansion device 10 has an alternate, expanded position, as shown in FIG. 2, in which a portion of the expansion pin 17 protrudes from the second tubing section, thereby increasing the circumference of the ring. The expanded position (FIG. 2) permits a ring 25 with the ring expansion device 10 to painlessly fit over the user's swollen knuckle, protuberance, or other problem area of the finger. Once the ring 25 is in place, it can be closed into the closed position shown in FIG. 1.

The inner diameter of the first tubing section 14*a* is approximately equal to the inner diameter of the second tubing section. Based on experimentation, the inside diameters of the tubing sections 14*a*, 14*b* are preferably between about 0.7 and about 1.6 millimeters, most preferably 1 millimeter. The expansion pin 17 is preferably made of between about 20 and about 24 gauge, most preferably 23 gauge, wire. Since this is a one unit 10 fits all, too large an inside diameter is not comfortable when the ring expansion device is installed on a smaller size ladies' ring. If the diameter is too small, it has been found herein that the expansion pin 17 is then too fine to lock securely. The first tubing section 14*a* is shorter in length than the second tubing section 14*b*.

Figure 3:
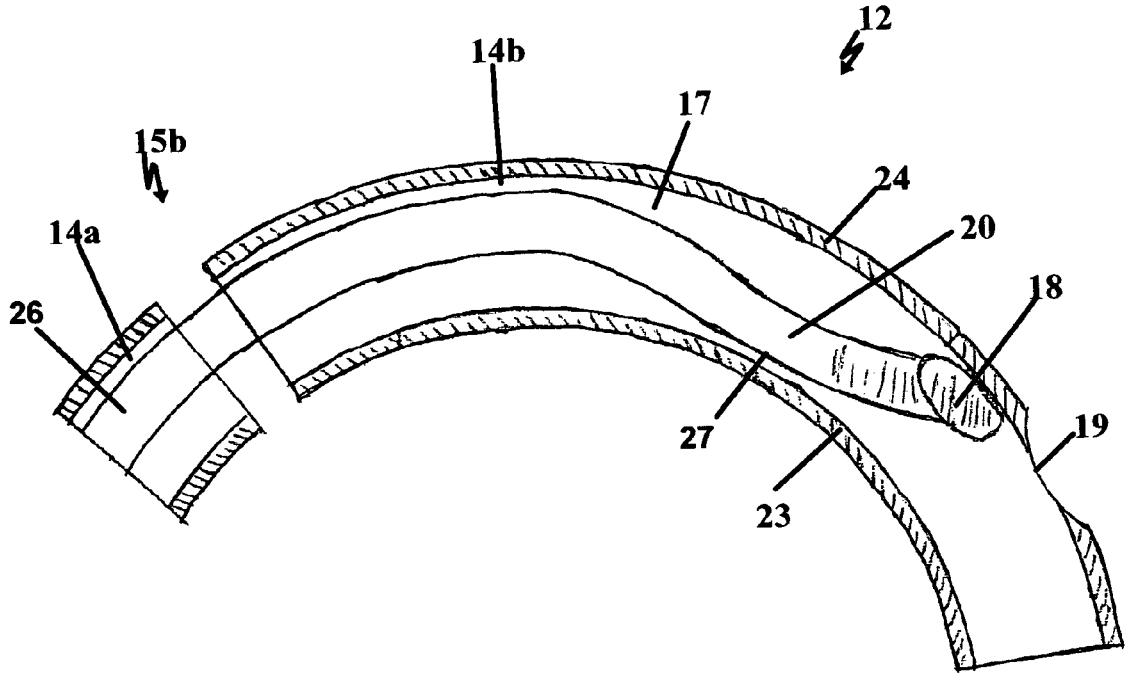
FIG. 3 is a cutaway, side elevational view of an expansion unit of a ring expansion device according to the present invention, shown in an expanded position.

Turning to FIG. 3, one (second) end portion 20 of the expansion pin 17 housed within the second tubing section 14*b* comprises a domed end 18. The opposite, first end portion 26 of the expansion pin 17 extends into the first tubing section 14*a*. When the ring expansion device 10 is in the closed position, the domed end 18 engages a receiving hole 19 in the second tubing section 14*b*. This locks the expansion unit 12 in place. In order to disengage the domed end 18 from the receiving hole 19 and slide the expansion pin 17 out of the second tubing section 14*b* when the ring expansion device is not in use, the second tubing section 16*b* is grasped and the first tubing section 16*a* is lightly pulled away from the second tubing section 16*b*. Alternatively, the first tubing section 16*a* is grasped and the second tubing section 16*b* is pulled away from the first tubing section 16*a*.

As seen in FIG. 1, the receiving hole 19, and expansion pin 17 when the ring is in the closed position, are hidden by the ring shank 16, which provides aesthetic and safety benefits. The hidden expansion pin 17 when the ring is in the closed position is also advantageous because it need not be made of a metal that matches the metal of the ring on which it is attached. The curvature of the sides of the curved tubing section 14*b* guides the curved dome 18 of the expansion pin 17 into the receiving hole 19.

Figure 5:
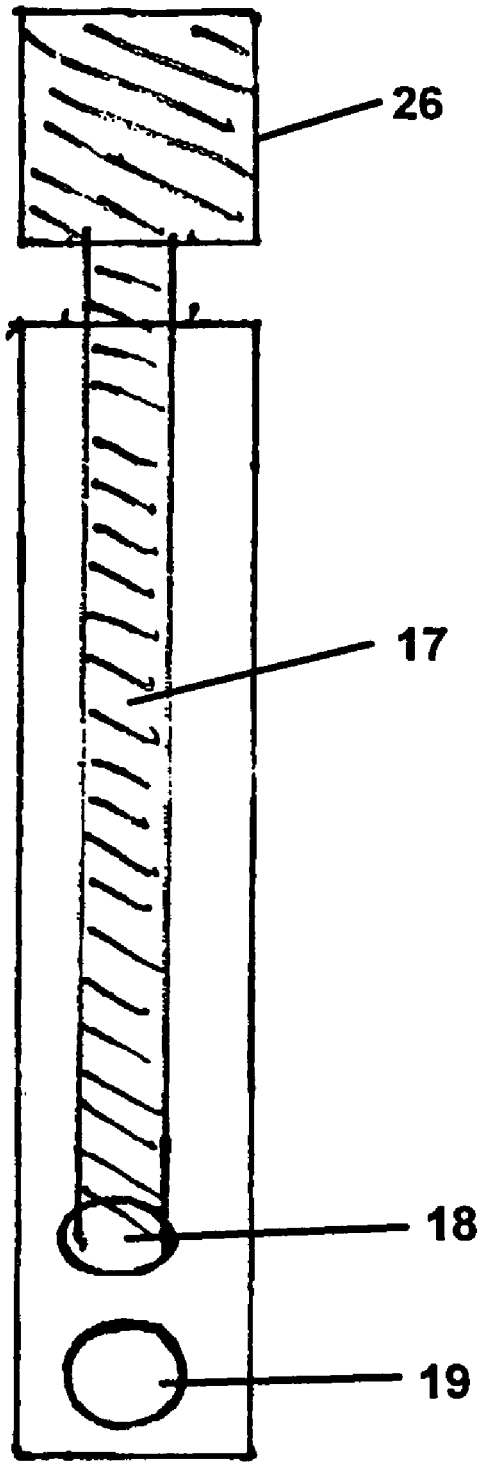
FIG. 5 is a top plan view of a ring expansion device according to the present invention.

Referring to FIGS. 3 and 5, in a preferred embodiment of the present invention, the end portion 20 of the expansion pin 17 is curved so that it bulges toward an inner side 23 of the second tubing section 14*b* (i.e., the prominence 27 of the curve extends toward the inner side 23). The domed end 18 touches an outer side 24 of the second tubing section 14*b* that is attached to the second shank portion 16*b* and through which the receiving hole 19 extends. As the expansion pin 17 moves through the second tubing section 16*b* during use, the end portion 20 is compressed against the outer side 24 and the domed end 18 glides against the outer side 24. This compression results in relatively slow and controlled movement of the expansion pin 17 in the second tubing section 16*b*. When the domed end 18 reaches the receiving hole 19, the outer side 24 no longer pushes against the domed end 18 and the domed end 18 springs into the receiving hole 19. The end portion 20 is somewhat resilient; thus, when the user pulls the first tubing section 14*a* away from the second tubing section 14*b*, or the second tubing section 14*b* away from the first tubing section 14*a*, the domed end 18 pops out of the receiving hole 19. This only requires slight pressure and is easy to do. The receiving hole 19 is gradually tapered to ease the movement of the domed end 18 into and out of the receiving hole 19.

The expandability of the ring shaft 11 (i.e., the distance that the circumference of the ring shaft 11 may be increased) depends upon the length of the expansion pin 17 and the range of the hinge 13. A ring expansion device 10 with a long expansion pin 17 and a wide hinge 13 expands to a larger ring size than a ring expansion device 10 with an expansion pin 17 that is shorter in length and a hinge 13 that is narrower in width.

Figure 4:
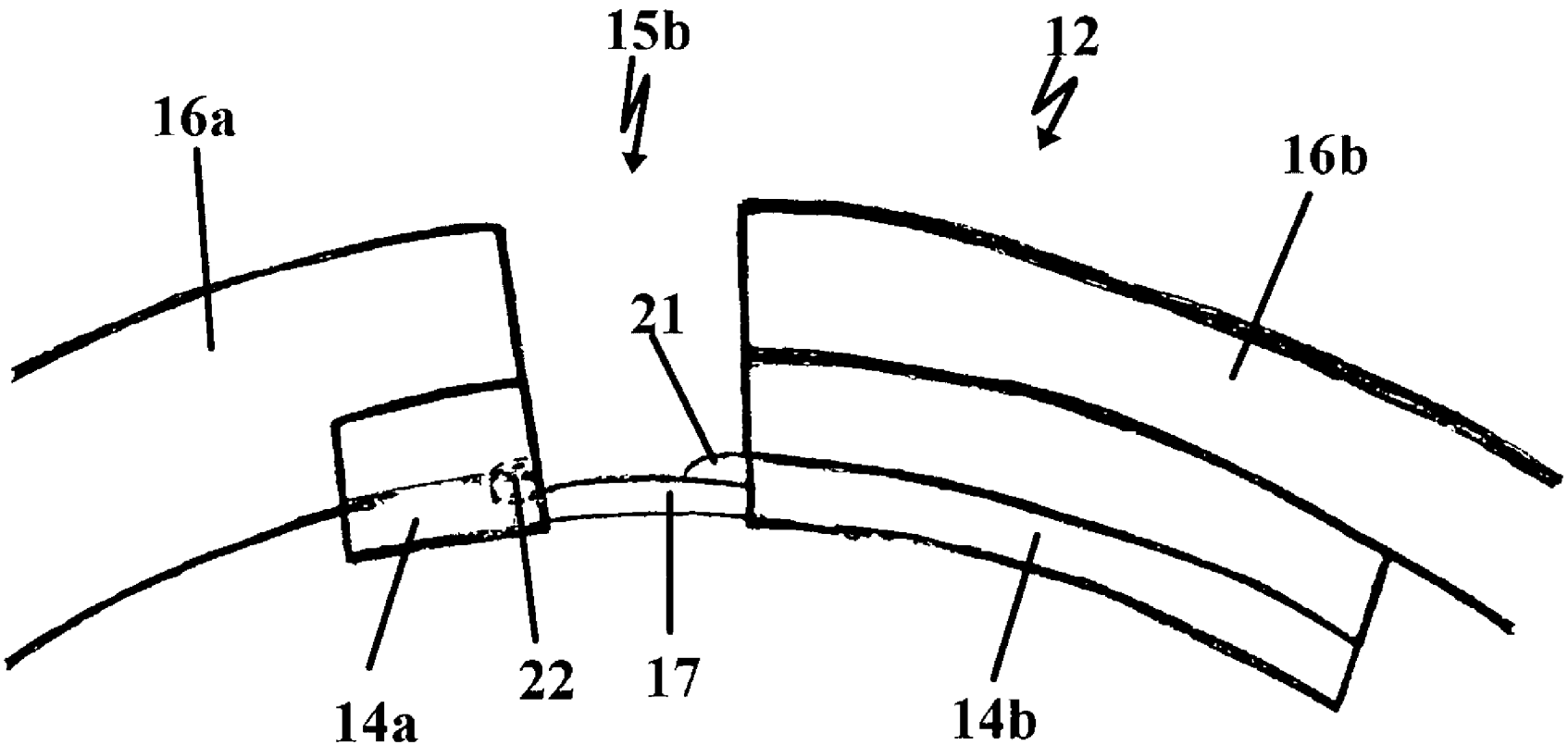
FIG. 4 is a side elevational view of an expansion unit of a ring expansion device according to the present invention, showing a lock protrusion and notch.

Referring to FIG. 4, the preferred embodiment of the ring expansion unit 10 further comprises a lock projection 21 and a complementary notch 22 for additionally securing the expansion unit 12 in the closed position. The lock projection 21 movably extends from the second tubing section 14b over the expansion pin 17 and partially surrounds the expansion pin 17. A portion of the second tubing section 14*b* may be removed to form the lock projection 21, or a separate piece of material may be soldered to the second tubing section 14*b* to form the lock projection 21. The complementary notch 22 is preferably fashioned by cutting away a small segment of the first tubing section 14*a* adjacent to the first shank portion 16*a* and the second cut 15*b*, and making a small groove in the first shank portion 16*a* adjacent the first tubing section 14*a* and the second cut 15*b*.

When the user slides the expansion pin 17 as far as it goes within the second tubing section 14*b*, the lock projection 21 engages the notch 22 to lock the ring expansion device 10 in the closed position. When the expansion pin 17 is initially withdrawn from the second tubing section 14*b*, the lock projection 21 disengages from the notch 22, allowing the increase in the circumference of the ring shank 11.

The expansion unit 12 and hinge 13 may be made of stainless steel, gold, silver, or any other metal. The expansion pin 17 is preferably made of a metal that may be tempered. The ring shank 11 and the tubing sections of the ring expansion device 10 are preferably made of the same metal for practical and aesthetic reasons.

Also included here in is a method of installing the ring expansion device 10 on a ring shank 11. First, the ring shank 11 is cut in two places 15*a*, 15*b* along imaginary line A-A (see FIG. 1). This forms the first and second shank portions 16*a*, 16*b*. The first shank portion 16*a* is one "half" of the ring shank 11 and the second shank portion is the other "half" of the ring shank 11. The term "half" is defined herein as approximately fifty percent of the shank's circumference. However, a precise cut is not crucial. This room for errors makes the ring expansion device 10 relatively easy to install. The person doing the installation need not be a fine craftsman.

Secondly, the expansion unit 12 is installed on the ring shank 11 at the second cut 15*b* in order to adjustably link the first and second shank portions 16*a*, 16*b*. The first tubing section 14*a* is attached to an inner face of the first shank portion 16*a* immediately next to the second cut 15*b*. Similarly, the second tubing section 14*b* is attached to an inner face of the second shank portion 16*b* immediately next to the second cut 15*b*. Before affixing the first tubing section 14*a* to the first shank portion 16*a*, the notch 22 must be carved out of the first tubing section 14*a* and the first shank portion 16*a*. The first end 26 of the expansion pin or shaft 17 is set within the first tubing section 14*a*, and the opposite, second end 20 of the expansion pin or shaft 17 is inserted into the second tubing section 14*b*.

The hinge 13 is installed on the ring shank 11 at the first cut 15*a* in order to pivotally link the first and second shank portions 16*a*, 16*b*. The two opposite ends of the small hinge 13 are preferably filed down so that they do not extend beyond the width of the ring shank 11, posing possible irritation to the wearer.

Thus, a preferred method of installing the ring expansion device 10 on a ring shank includes the steps of:

(a) making first and second cuts 15*a*, 15*b* through the ring shank 11, the first cut 15*a* preferably being about diametrically opposite the second cut 15*b*, the cuts forming a first shank portion 16*a* and a second shank portion 16*b*;

(b) pivotally linking the first shank portion 16*a* and the second shank portion 16*b* at the first cut 15*a* with an appropriately sized hinge 13;

(c) attaching a first, hollow tubing section 14*a* of an expansion unit 12 to an inner edge of the first shank portion 16*a* adjacent the second cut 15*b*;

(d) sliding a second end portion 20 of an expansion pin or shaft 17 with a first end portion attached inside a second hollow tubing section 14*b* into the hollow first tubing section 14*b*; and (e) attaching the second hollow tubing section 14*b* of the expansion unit 12 to an inner edge of the second shank portion 16*b* adjacent the second cut 15*b*. Attachment of the two hollow tubing section 14*a*, 14*b* is preferably by soldering them into grooves cut into the metal of the ring shank for receiving the expansion unit 10.

Preferably, the first end portion 26 of the expansion pin or shaft 17 is permanently affixed within the first tubing section 14*a*. Preferably, the second end portion 20 of the expansion pin or shaft 17 is curved, the curve having a prominence 27 extending toward an inner side of the second tubing section 14b.

In order to put on a ring 25 having the ring expansion device 10 installed on it, the user pulls the halves of the ring shank 11 apart, causing the expansion pin or shaft 17 to pull out of the second tubing section 14*b* until the expansion unit 12 is partially or fully expanded. The expansion unit 12 should be extended until the circumference of the ring is large enough to slide painlessly over any swollen knuckle, infected area, protuberance, etc. on a user's finger. Once the ring 25 reaches the desired position along the length of the finger, the user squeezes the two halves of the ring shank together, which pushes the expansion pin or shaft 17 into the second tubing section 14*b* until the expansion unit 12 is in the closed position, the domed end 18 engages the receiving hole 19, and the lock projection 21 engages the notch 22.

In order to remove a ring 25 with the ring expansion device 10 installed on it, the user pulls apart the two halves 16 of the ring shank 11, which pulls the expansion pin or shaft 17 from the second tubing section 14*b* until the expansion unit 12 is partially or fully expanded. The expansion unit 12 should be extended until the circumference of the ring shank 11 is large enough to be clear of any swollen knuckle, protuberance, or other problem area on the user's finger. The ring 25 is then removed from the user's finger. Although the ring 25 may be stored with the expansion unit 12 in either the expanded position or the closed position, it is preferably stored in the closed position.

With currently available adjustable ring shank devices, an eternity ring, for example, must be cut in half and half of the eternity ring must be discarded in order to install the device. With the ring expansion device of the present invention, there is no need to discard half of the ring. Many currently available ring shank devices must be purchased in a certain size according to the size of the wearer's ring and the color of the ring metal. With the present invention, one expansion unit 10 fits all rings, regardless of the size or color of the ring. The jeweler need not purchase many different sizes/colors of ring devices.

No tension spring is employed in the ring expansion unit, and the ring that it is installed in need not be made of a springy metal. The ring expansion device 10 can be used on any type of ring made of any type of metal.

An openable ring 25 for wearing on a person's finger or toe, which comprises:

(a) first and second arcuate shank portions 16*a*, 16*b* hinged to one another at a first, cut end 15*a* of each shank portion 16*a*, 16*b*, and (b) a ring expansion unit 10 attached at an opposite, cut end 15*b* of each shank portion 16*a*, 16*b;* wherein the expansion unit 10 comprises a first, hollow tubing section 14*a*, an expansion pin or shaft 17 having a first end portion mounted in the first tubing section 14*a*, and a second, hollow tubing section 14*b* slidably supporting an opposite, second end portion of the expansion pin or shaft 17. The ring 25 pivots between an open and a closed position, the ring actually being physically closed even when it is in the open position. Thus, the ring 25 forms a circle with a larger diameter when it is in the closed position than the diameter of the ring when it is in a closed position. When the ring is opened, the hinged, first ends of the shank portions 15*a* contact one another, and the opposite, second cut ends 15*b* open, with the ring expansion pin 17 in between.

From the foregoing it can be realized that the described device of the present invention may be easily and conveniently utilized as an expansion device for altering the size of a ring so that the wearer can wear it . It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 ring expansion device
11 ring shank
12 expansion unit
13 hinge
14*a* first tubing section
14*b* second tubing section
15*a* first cut in ring shank
15*b* second cut in ring shank
16*a* first shank portion
16*b* second shank portion
17 expansion pin or shaft
18 domed end
19 receiving hole
20 second end portion
21 lock projection
22 notch
23 inner side
24 outer side
25 ring
26 second end portion
27 prominence of curve

What is claimed is:

1. A ring expansion device for expanding the circumference of a ring shank, the ring expansion device comprising an expansion unit that is attachable to an inner surface of the ring shank outside the ring shank the expansion unit comprising: a first, hollow tubing section, an expansion pin or shaft having a first end portion mounted in the first tubing section, and a second, hollow tubing section slidably supporting an opposite, second end portion of the expansion pin or shaft; the second end portion of the expansion pin or shaft within the second tubing section comprising a single domed end, the single domed end being opposite the first end of the expansion pin or shaft, the domed end being engageable with a receiving hole in the second tubing section; wherein the expansion unit is portable and movable from one existing ring shank to another.

2. The ring expansion device according to claim 1, wherein the domed end of the expansion unit contacts an outer side of the second tubing section and the receiving hole is in the outer side of the second tubing section; the inner side of the second tubing section being opposite and parallel to the curved outer side of the second tubing section, the outer side of the second tubing section being adjacent the ring shank when the expansion unit is attached to the ring shank.

3. The ring expansion device according to claim 2, wherein the curve of the expansion pin comprises a prominence extending toward an inner side of the second tubing section and in an opposite direction from a curved outer side 24 of the second tubing section, the curve prominence of the expansion pin or shaft being adjacent the domed end.

4. The ring expansion device according to claim 3, wherein the hollow tubing sections have an inside diameter of between about 0.7 and about 1.6 millimeters.

5. The ring expansion device according to claim 1, wherein the second end portion of the expansion pin or shaft is curved, and is resilient; and the ring expansion device is installable and functional on an existing eternity ring.

6. The ring expansion device according to claim 1, further comprising a mechanism for temporarily locking the expansion unit in a closed position.

7. The ring expansion device according to claim 1, wherein the expansion unit further comprises a lock projection extending from the second tubing section over the expansion pin or shaft, the lock projection being engageable with, and disengageable from, a complementary notch in the second tubing section.

8. The ring expansion device according to claim 7, wherein the expansion pin is soldered into the first tubing section; and the ring expansion device is locked in a closed position when the lock projection is engaged in the complementary notch.

9. The ring expansion device according to claim 1, wherein the first, hollow tubing section is shorter in length than the second, hollow tubing section, and the first and second tubing sections are about equal in inside diameter.

10. The ring expansion device according to claim 2, wherein the expansion pin or shaft is made of between about 20 and about 24 gauge wire.

11. A method of installing a ring expansion device on an existing ring, the method comprising the steps of:

(a) making first and second cuts through a shank of the ring, the first cut being about diametrically opposite the second cut, and the cuts forming a first shank portion and a second shank portion;

(b) pivotally linking the first shank portion and the second shank portion at the first cut with a hinge;

(c) attaching a first, hollow tubing section of an expansion unit of the ring expansion device to an outside surface of an inner side of the first shank portion adjacent the second cut;

(d) sliding a second end portion of an expansion pin or shaft with a first end portion attached inside the first, hollow tubing section into a second, hollow tubing section; and (e) attaching the second hollow tubing section of the expansion unit to an outside surface of an inner side of the second shank portion adjacent the second cut.

12. The method of installing a ring expansion device according to claim 11, further comprising the step of filing ends of the hinge so that the hinge is no wider than the width of the ring shank.

13. The method of installing a ring expansion device according to claim 11, wherein the first end portion of the expansion pin or shaft is permanently affixed within the first tubing section.

14. The method of installing a ring expansion device according to claim 11, wherein the second end portion of the expansion pin or shaft is curved, the curve having a prominence extending toward an inner side of the second tubing section, the expansion pin or shaft extending substantially the length of the second tubing section when the expansion device is in a closed position.

15. The method of installing a ring expansion device according to claim 11, wherein the expansion unit comprises a closed, locked position in which a lock projection extending from the second tubing section over the expansion pin and partially surrounding the expansion pin or shaft engages a notch adjacent the first tubing section.

16. An openable ring for wearing on a person's finger or toe, the ring comprising: (a) first and second arcuate shank portions hinged to one another at a first, cut end of each shank portion, and (b) a ring expansion unit attached at an opposite, second cut end of each shank portion; wherein the expansion unit comprises a first, hollow tubing section, an expansion pin or shaft having a first end portion mounted in the first tubing section, and a second, hollow tubing section slidably supporting an opposite, second end portion of the expansion pin or shaft; the ring expansion unit further comprising a lock projection extending from the second tubing section over the expansion pin or shaft, the lock projection being engageable with, and disengageable from, a complementary notch in the second tubing section.

17. The ring according to claim 16, further comprising the step of simultaneously opening the ring shank and the expansion unit, which withdraws the expansion pin or shaft from the second tubing section and places the ring in the open position; wherein the ring is pivotable between an open and a closed position.

18. The ring according to claim 17, wherein, when the ring is in the open position, the opposite, second cut ends are apart, with a portion of the ring expansion pin in between the second cut ends.

* * * * *